US011352188B2

(12) United States Patent
Reynolds et al.

(10) Patent No.: US 11,352,188 B2
(45) Date of Patent: Jun. 7, 2022

(54) PROTECTIVE PACKAGING DEVICE

(71) Applicant: Signode Industrial Group LLC, Glenview, IL (US)

(72) Inventors: Robert Reynolds, Leasburg, NC (US); Scott Daniel, Vernon Hills, IL (US)

(73) Assignee: Signode Industrial Group LLC, Tampa, FL (US)

( * ) Notice: Subject to any disclaimer, the term of this patent is extended or adjusted under 35 U.S.C. 154(b) by 0 days.

(21) Appl. No.: 17/308,389

(22) Filed: May 5, 2021

(65) Prior Publication Data

US 2022/0009691 A1 Jan. 13, 2022

Related U.S. Application Data

(60) Provisional application No. 63/068,077, filed on Aug. 20, 2020, provisional application No. 63/049,797, filed on Jul. 9, 2020.

(51) Int. Cl.
*B65D 81/05* (2006.01)

(52) U.S. Cl.
CPC ..... *B65D 81/055* (2013.01)

(58) Field of Classification Search
CPC .. B65D 81/055; B65D 81/056; B65D 81/107; B65D 81/127; B65D 81/053; B65D 81/054; B65D 81/03; B65D 81/057; B65D 81/058
USPC ..... 206/587, 521, 325, 322, 453
See application file for complete search history.

(56) References Cited

U.S. PATENT DOCUMENTS

| | | | | |
|---|---|---|---|---|
| 2,746,667 | A * | 5/1956 | Murphy | B65D 85/48 206/588 |
| 2,967,009 | A * | 1/1961 | Lidgard | B65D 5/5052 206/448 |
| 3,362,609 | A * | 1/1968 | Freedy | B65D 5/504 206/587 |
| 3,725,188 | A * | 4/1973 | Kalt | A47B 95/043 428/172 |
| 4,606,959 | A * | 8/1986 | Hillinger | E04C 2/365 428/116 |
| 4,700,844 | A * | 10/1987 | Griffith | B65D 85/48 206/453 |
| 5,934,473 | A * | 8/1999 | Belshe | B65B 61/20 206/583 |
| 7,204,070 | B2 | 4/2007 | Metz et al. | |
| D663,201 | S | 7/2012 | Carroll | |
| D667,727 | S | 9/2012 | Diaz et al. | |
| 8,753,731 | B2 * | 6/2014 | Dunn | B65D 81/056 428/116 |
| D773,299 | S | 12/2016 | Gray et al. | |
| 2010/0326875 | A1 * | 12/2010 | Wycech | B29C 66/1122 206/521 |
| 2018/0237202 | A1 * | 8/2018 | Kyle | B32B 29/005 |
| 2018/0290819 | A1 * | 10/2018 | Hokanson | B65D 5/5069 |
| 2019/0270570 | A1 * | 9/2019 | Jette | B31D 5/006 |

FOREIGN PATENT DOCUMENTS

| | | | | |
|---|---|---|---|---|
| WO | WO-9828205 | A1 * | 7/1998 | B31F 1/0009 |

* cited by examiner

*Primary Examiner* — Rafael A Ortiz
(74) *Attorney, Agent, or Firm* — Neal, Gerber & Eisenberg LLP

(57) ABSTRACT

Various embodiments of the present disclosure provide a protective packaging device for protecting a product during storage, shipping, and handling.

22 Claims, 11 Drawing Sheets

PROTECTIVE PACKAGING DEVICE

PRIORITY

This application claims priority to and the benefit of U.S. Provisional Patent Application No. 63/049,797, filed Jul. 9, 2020, and U.S. Provisional Patent Application No. 63/068,077, filed Aug. 20, 2020, the entire contents of both of which are incorporated herein by reference.

FIELD

The present disclosure relates to protective packaging devices for protecting products from damage during storage, shipping, and handling.

BACKGROUND

Most (if not all) products are susceptible to damage during storage, shipping, and handling. Several types of protective packaging devices exist to reduce the likelihood of product damage. In many cases multiple types of protective packaging devices are used together to form protective packaging solutions to protect products. For instance, smaller products such as consumer electronics are commonly packaged in cardboard boxes filled with shock-absorbing dunnage (such as bubble wrap or foam peanuts). For larger products such as appliances, shock-absorbing foam or kraft-paper honeycomb is applied to vulnerable areas of the products (such as the edges and corners) before the products are enclosed within large cardboard boxes.

SUMMARY

Various embodiments of the present disclosure provide a protective packaging device for protecting a product during storage, shipping, and handling.

DETAILED DESCRIPTION

Figure 1:
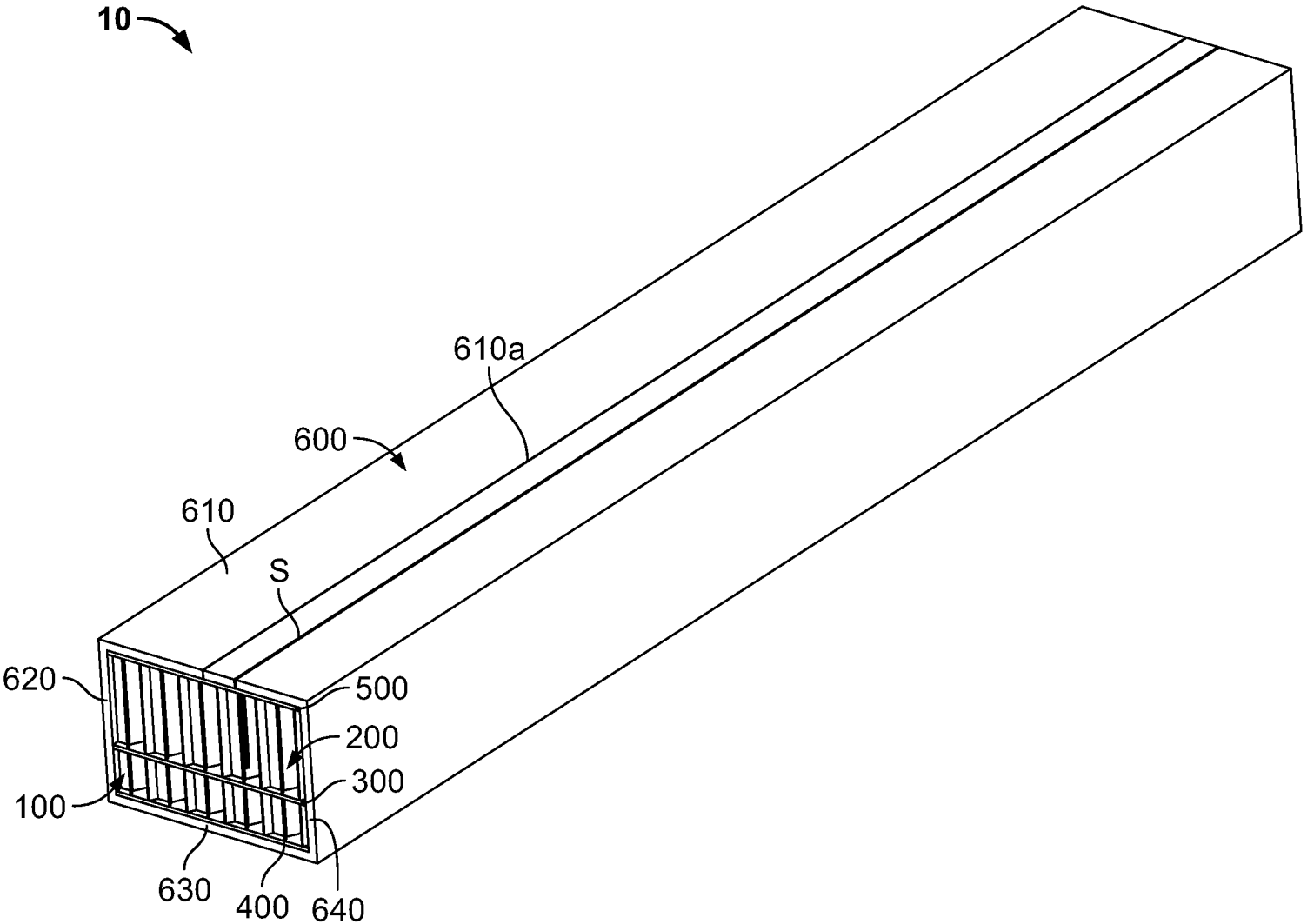
FIG. 1 is a perspective view of one example embodiment of the protective packaging device of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Figure 10:
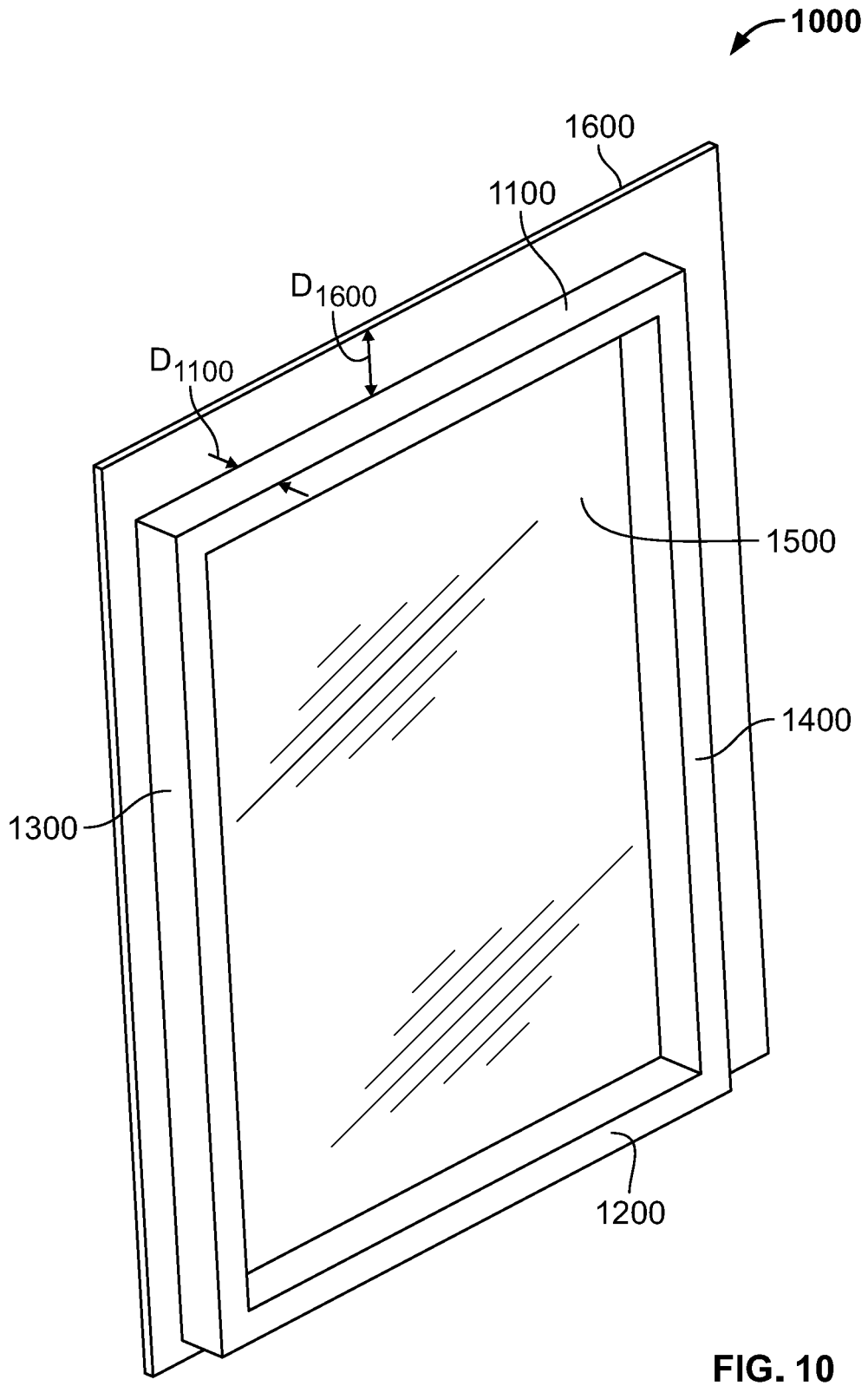
FIG. 10 is a perspective view of an example window.

Various embodiments of the present disclosure provide a protective packaging device for protecting a product during storage, shipping, and handling. FIGS. 1-9 show one example protective packaging device 10 of the present disclosure that is configured to be installed onto a product, such as the window 1000 shown in FIG. 10, to protect the product from damage during storage, shipping, and handling.

The window 1000 includes a first stile 1100, a second stile 1200, a first rail 1300, a second rail 1400, a pane of glass 1500, and a flange 1600. The first and second stiles 1100 and 1200 are spaced-apart in the vertical direction. The first and second rails 1300 and 1400 extend between the first and second stiles 1100 and 1200 and are themselves spaced-apart in the horizontal direction. The pane of glass 1500 is positioned in the area bounded by the first and second stiles 1100 and 1200 and the first and second rails 1300 and 1400. The flange 1600 extends outwardly from the first and second stiles 1100 and 1200 and the first and second rails 1300 and 1400. The outer edge of the flange 1600 forms the perimeter of the window 1000 and is offset a distance $D_{1600}$ from the first and second stiles 1100 and 1200 and the first and second rails 1300 and 1400. The inner edges of the first and second stiles 1100 and 1200 and the first and second rails 1300 and 1400 are offset a distance $D_{1100}$ from the flange 1600.

Turning to the protective packaging device 10, the protective packaging device 10 includes a first core 100, a second core 200, a separator 300, a first core cover 400, a second core cover 500, an outer wrap 600, and a retaining material 700.

Figure 8:
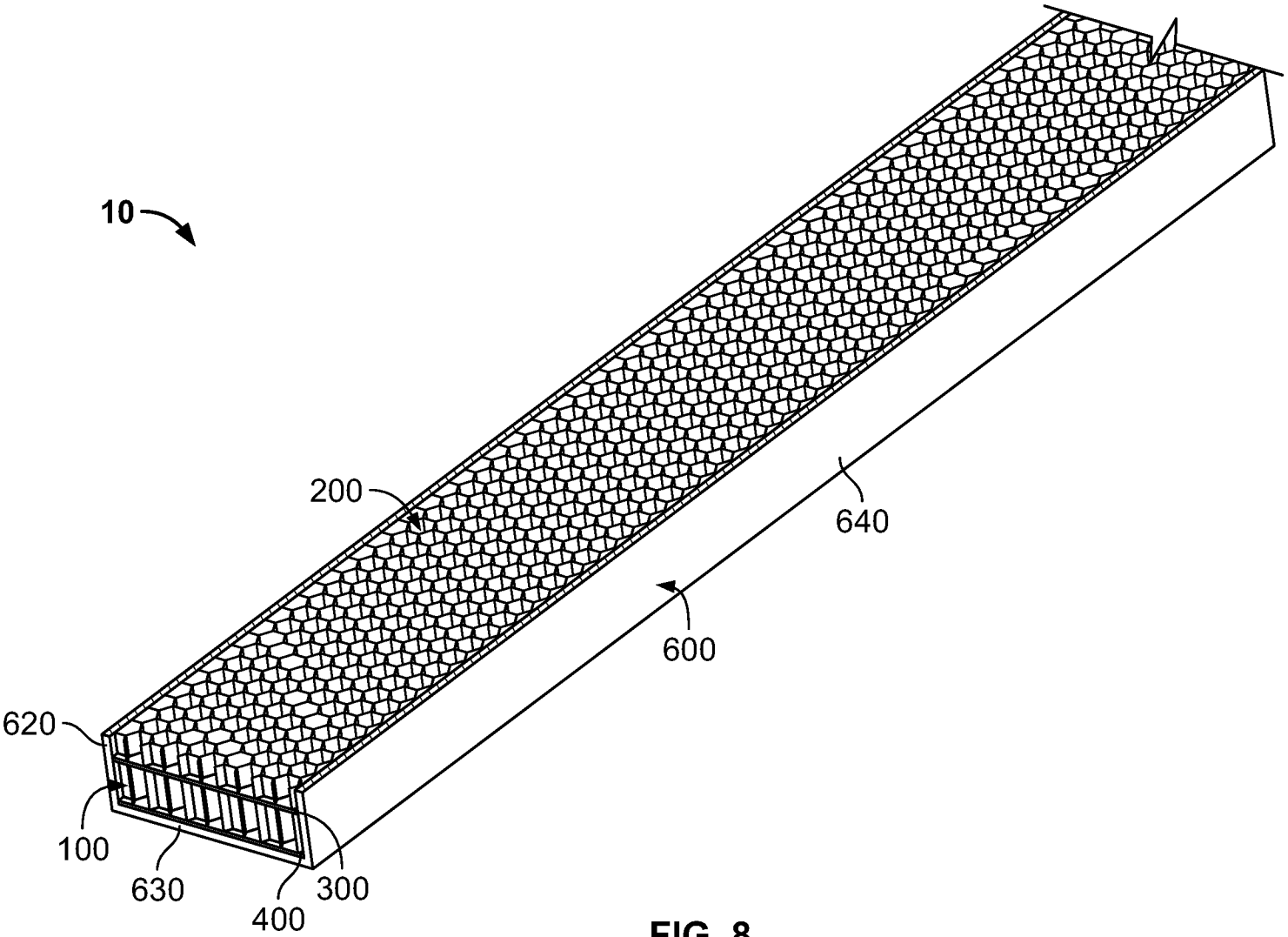
FIG. 8 is a cross-sectional perspective view of the protective packaging device of FIG. 1 taken substantially along the line 8-8 of FIG. 2.
Figure 9:
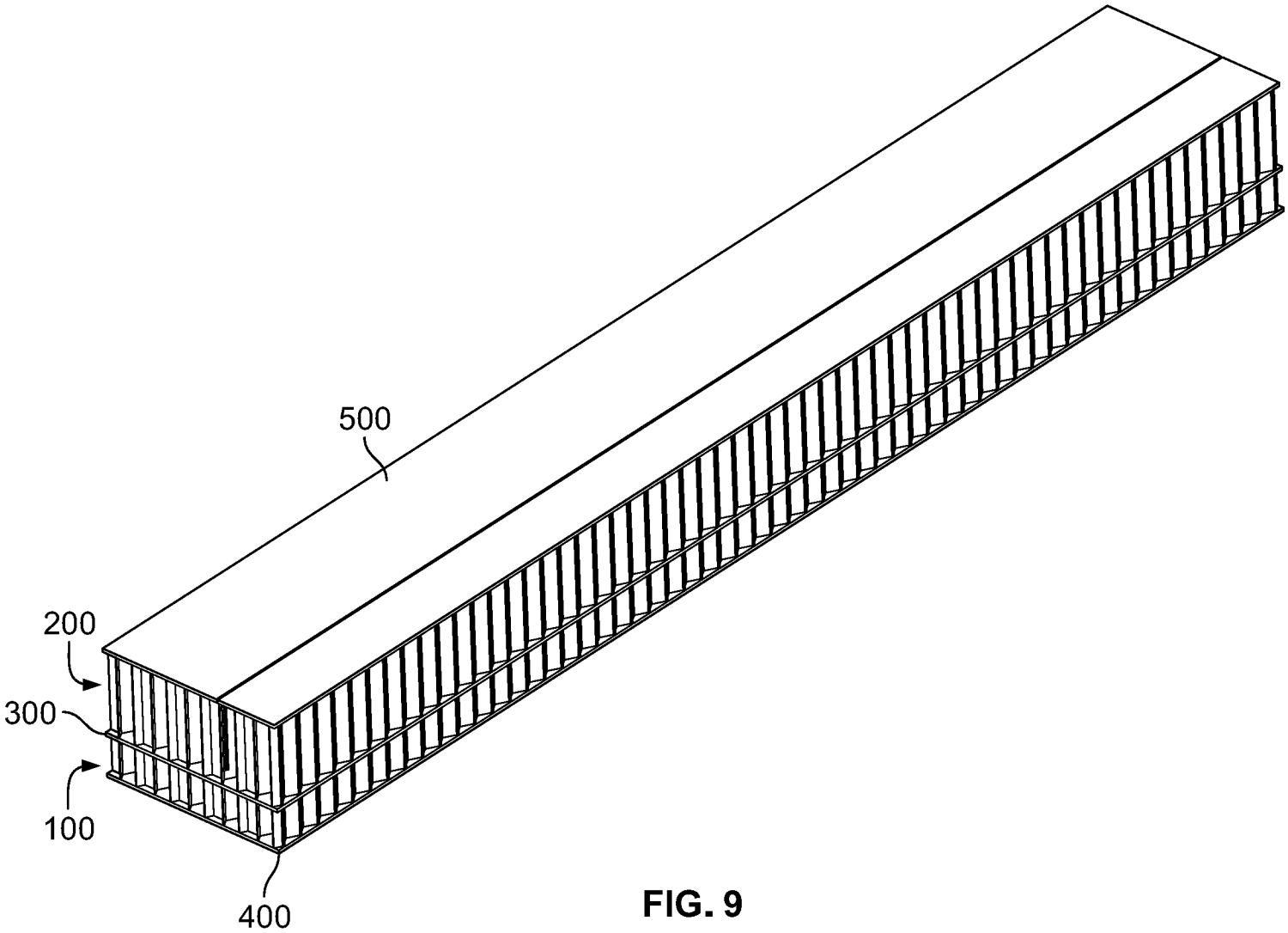
FIG. 9 is a perspective view of the protective packaging device of FIG. 1 with the cover removed.

In this example embodiment, the first core 100 has a cellular structure (similar to the cellular structure of the second core 200 shown in FIG. 8) that provides strength while remaining relatively lightweight. The first core 100 has a length L (which corresponds to the length of the protective packaging device 10) and a height $H_{100}$. Here, the first core 100 is formed from a paperboard material formed into multiple hexagonal cells to create a honeycomb structure. In other embodiments, material other than paperboard is used to form the cellular structure of the first core 100. In further embodiments, the first core 100 has a structure other than a cellular structure. For instance, in one such embodiment the first core 100 is formed from a block of foam or a block formed from layers of corrugated fiberboard attached together (such as via adhesive).

In this example embodiment, the second core 200 has a cellular structure (shown in FIG. 8) that provides strength while remaining relatively lightweight. The second core 200 has a length L (which corresponds to the length of the protective packaging device 10) and a height $H_{200}$. The height $H_{200}$ is greater than the height $H_{100}$. In this example embodiment, the height $H_{200}$ is about twice the height $H_{100}$, though the height $H_{200}$ may be any suitable amount larger than the height $H_{100}$. In certain embodiments, the heights $H_{100}$ and $H_{200}$ are equal or the height $H_{100}$ is greater than the height $H_{200}$. Here, the second core 200 is formed from a paperboard material formed into multiple hexagonal cells to create a honeycomb structure. In other embodiments, material other than paperboard is used to form the cellular structure of the second core 200. In further embodiments, the second core 200 has a structure other than a cellular structure. For instance, in one such embodiment the second core 200 is formed from a block of foam or a block formed from layers of corrugated fiberboard attached together (such as via adhesive).

In this example embodiment, the first and second cores 100 and 200 have the same cellular structure. In other embodiments, the first and second cores 100 and 200 have different cellular structures. For instance, in some embodiments, the first core 100 has cells with larger cross-sectional areas than those of the second core 200 (or vice-versa). As used herein with respect to a cell of a core, "cross-sectional area" means the empty two-dimensional area enclosed by the walls of the cell when viewed from a plane perpendicular to the height of the core that cell is a part of. Cells with larger cross-sectional areas provide more shock absorption performance (i.e., are weaker in compression) than cells with relatively smaller cross-sectional areas, which are more rigid. In embodiments in which the first core has cells with larger cross-sectional areas as compared to those of the second core, the first core acts as a shock absorber and deforms to absorb shocks (rather than transmit them to the product) while the more rigid second core supports the product. Cells with larger cross-sectional areas are also cheaper to manufacture since they use less paperboard.

The separator 300 is attached to the top of the first core 100 and the bottom of the second core 200 and separates the first core 100 from the second core 200 in the vertical direction. In this example embodiment, the separator 300 includes a double-ply layer of paperboard attached (such as via adhesive or in any other suitable manner) on one side to the top of the first core 100 and attached (such as via adhesive or in any other suitable manner) on the other side to the bottom of the second core 200. The separator 300 covers the open tops of the cells of the first core 100 and the open bottoms of the cells of the second core 200 (so the cells extend in the same (vertical) direction) and adds rigidity to the first and second cores 100 and 200 to help maintain its cellular structure. In other embodiments, the separator 300 may be formed from any suitable quantity of plies (including only one ply) of paperboard or formed from any other suitable material (such as plastic or corrugated fiberboard).

The first core cover 400 is attached to the bottom of the first core 100 and separates the first core 100 from the outer wrap 600 (described below) in the vertical direction. In this example embodiment, the first core cover 400 includes a single-ply layer of paperboard attached (such as via adhesive or in any other suitable manner) on one side to the bottom of the first core 100 and attached (such as via adhesive or in any other suitable manner) on the other side to the outer wrap 600. The first core cover 400 covers the open bottoms of the cells of the first core 100 and adds rigidity to the first core 100 to help maintain its cellular structure. In other embodiments, the first core cover 400 may be formed from a multi-ply layer of paperboard or formed from any other suitable material (such as plastic or corrugated fiberboard). In some embodiments, the protective packaging device 10 does not include the first core cover 400.

The second core cover 500 is attached to the top of the second core 200 and separates the second core 200 from the outer wrap 600 (described below) in the vertical direction. In this example embodiment, the second core cover 500 includes a single-ply layer of paperboard attached (such as via adhesive or in any other suitable manner) on one side to the top of the second core 200 and attached (such as via adhesive or in any other suitable manner) on the other side to the outer wrap 600. The second core cover 500 covers the open tops of the cells of the second core 200 and adds rigidity to the second core 200 to help maintain its cellular structure. In other embodiments, the second core cover 500 may be formed from a multi-ply layer of paperboard or formed from any other suitable material (such as plastic or corrugated fiberboard). In some embodiments, the protective packaging device 10 does not include the first core cover 400.

The outer wrap 600 is wrapped around and partially encloses the tops, bottoms, and sides of the first core 100, the second core 200, the separator 300, the first core cover 400, and the second core cover 500. The outer wrap 600 is generally tubular with a rectangular cross-section, and includes a top wall 610, a first side wall 620, a bottom wall 630 opposite the top wall 610, and a second side wall 640 opposite the first side wall 620. The top wall 610 is attached (such as via adhesive or in any other suitable manner) to the second core cover 500, and the bottom wall 630 is attached (such as via adhesive or in any other suitable manner) to the first core cover 400. In certain embodiments, the first side wall 620 and/or the second side wall 640 are attached (such as via adhesive or in any other suitable manner) to one or both of the first core 100 and the second core 200. In this example embodiment, the outer wrap 600 is formed from a single piece of chipboard sized so its two ends meet at a junction 610*a* in the top wall 610 when wrapped around the first core 100, the second core 200, the separator 300, the first core cover 400, and the second core cover 500. The outer wrap 600 may be formed from any other suitable material (such as corrugated fiberboard, plastic, or wood) in other embodiments. In certain embodiments the outer wrap 600 covers the fronts and backs of the above-listed components. In some embodiments, the protective packaging device 10 does not include the outer wrap 600.

Figure 2:
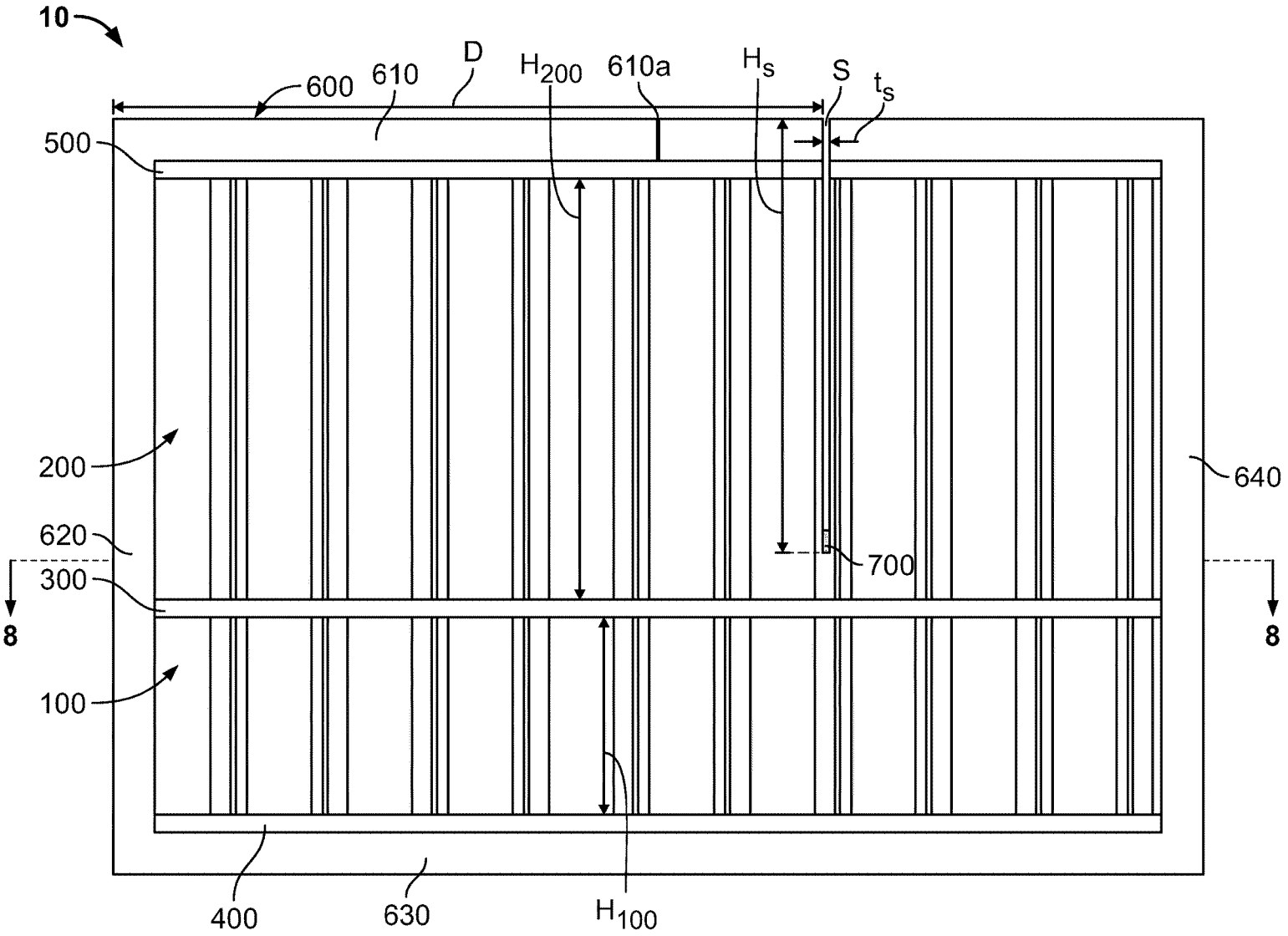
FIG. 2 is a front elevational view of the protective packaging device of FIG. 1.
Figure 3:
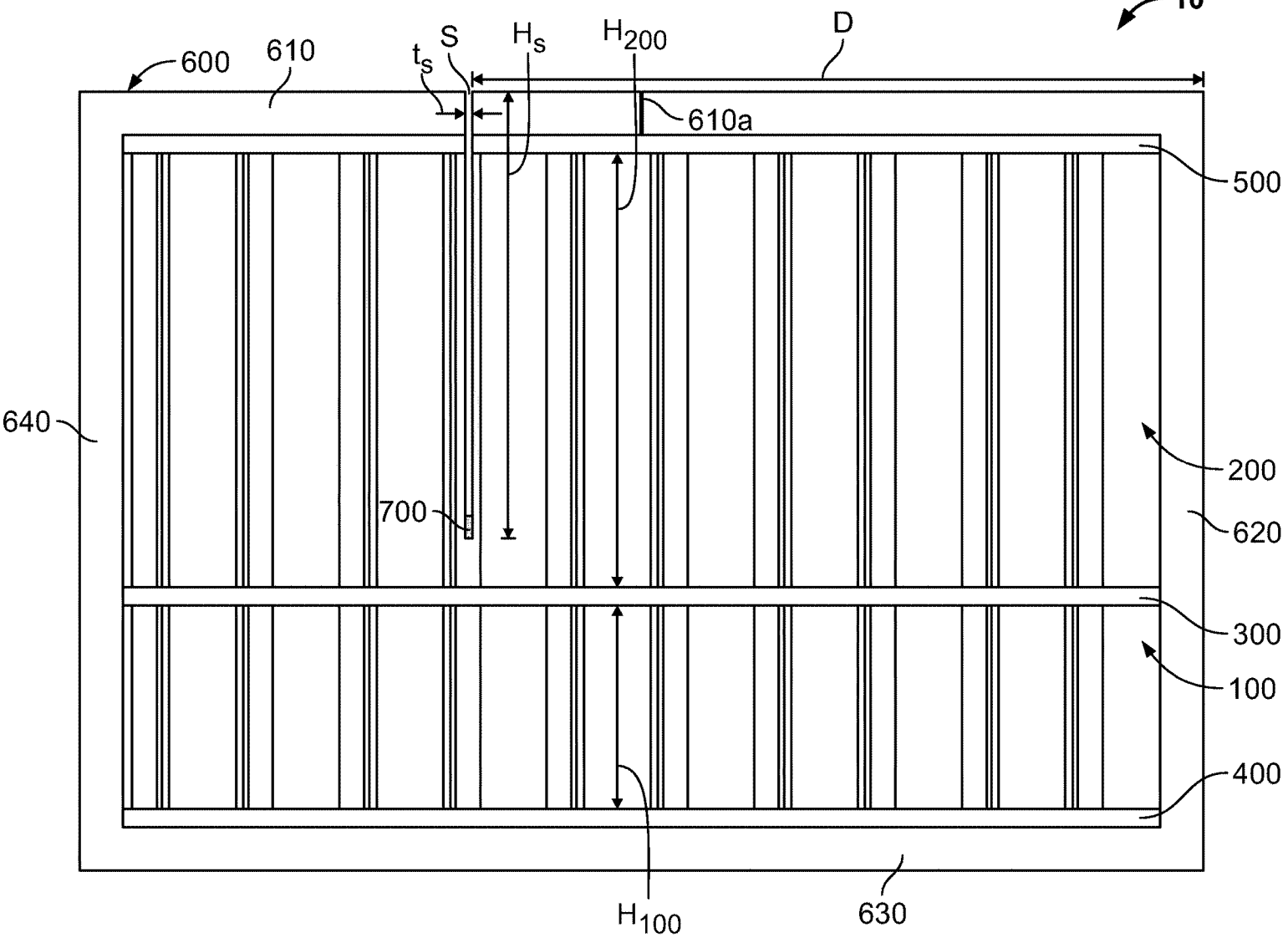
FIG. 3 is a back elevational view of the protective packaging device of FIG. 1.
Figure 4:
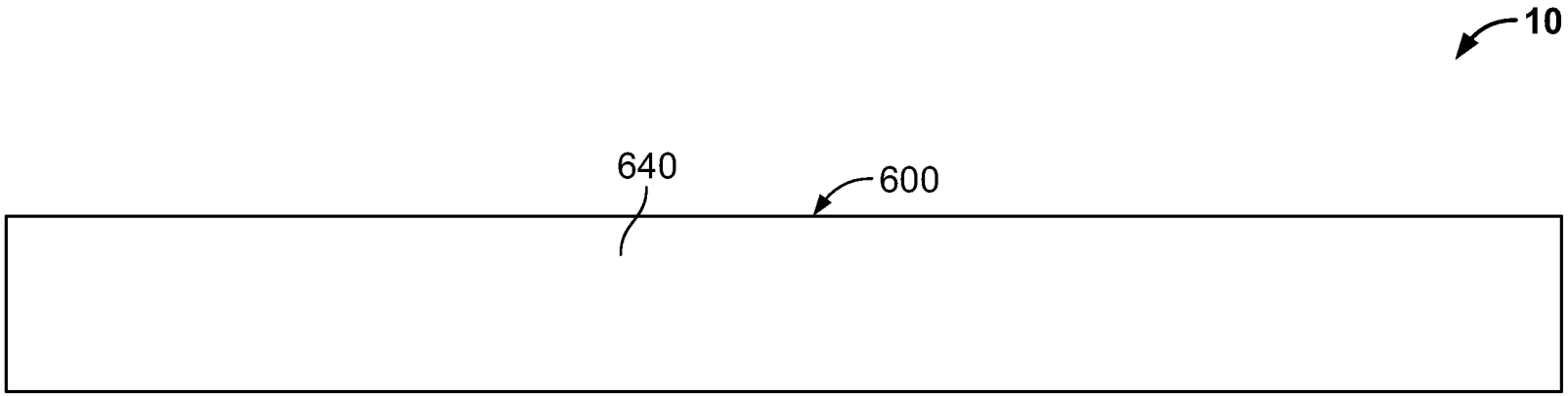
FIG. 4 is a right-side elevational view of the protective packaging device of FIG. 1.
Figure 5:
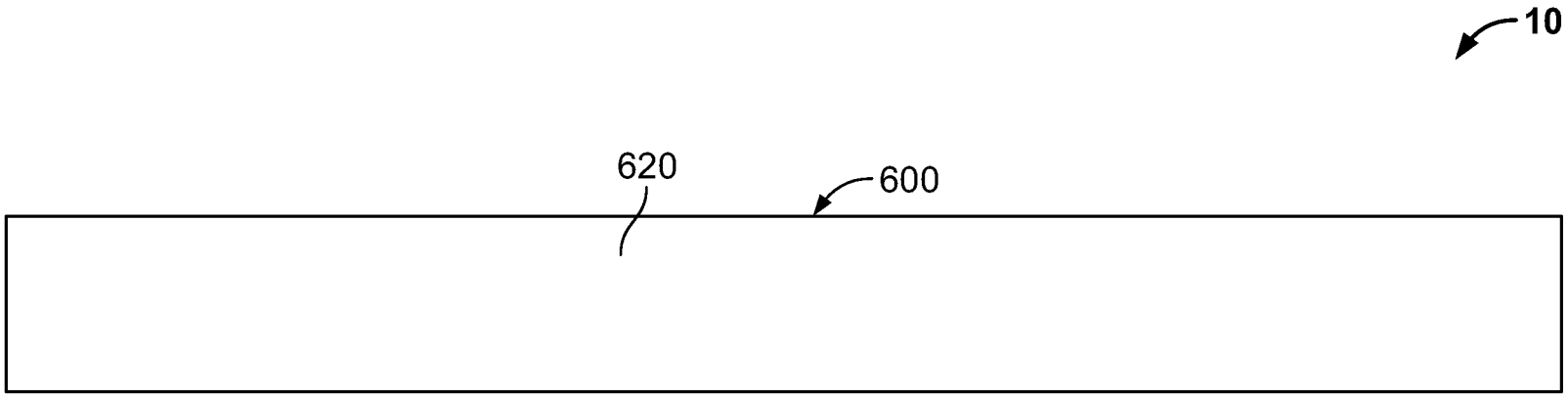
FIG. 5 is a left-side elevational view of the protective packaging device of FIG. 1.
Figure 6:
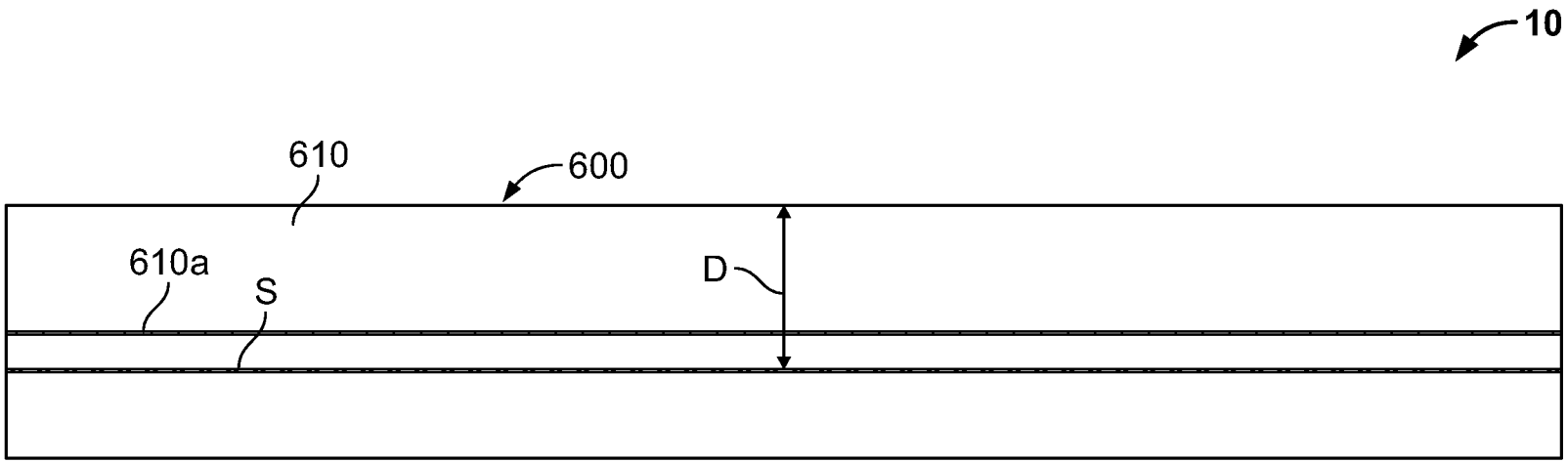
FIG. 6 is a top-plan view of the protective packaging device of FIG. 1.
Figure 7:
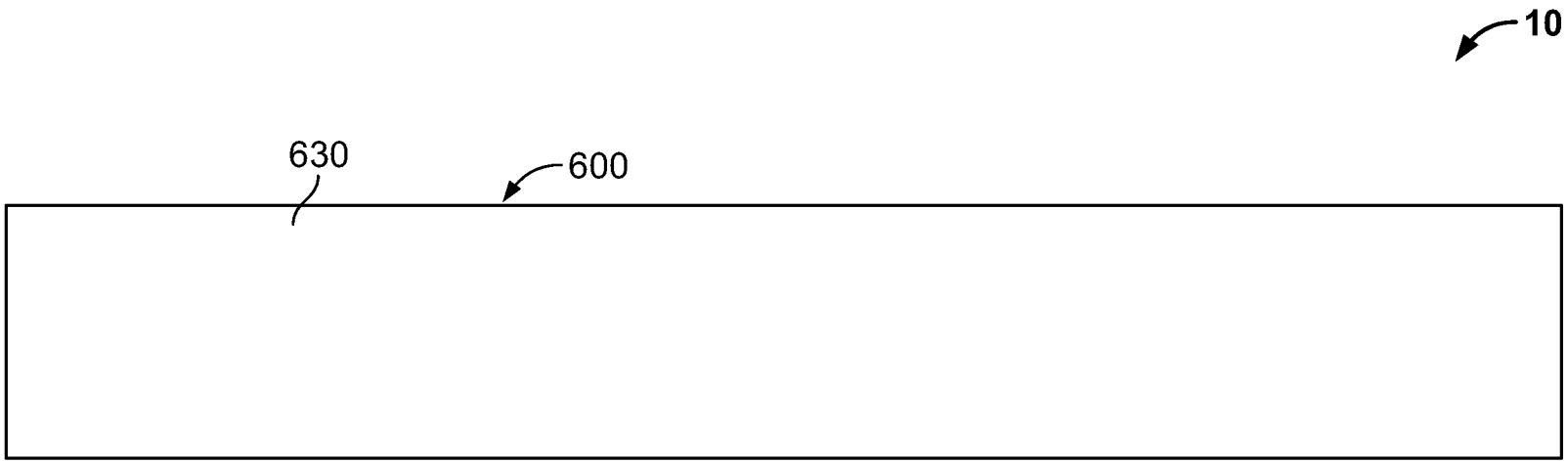
FIG. 7 is a bottom-plan view of the protective packaging device of FIG. 1.

As best shown in FIGS. 1-3, a product-receiving opening S—referred to as the flange-receiving opening S below—is formed in the protective packaging device 10. In this example embodiment, the flange-receiving opening S extends along the length L of the protective packaging device 10 (though it does not extend along the entire length L in other embodiments) and extends downward from the top wall 610 of the outer wrap 600, proceeds partially through the second core 200, and terminates before reaching the separator 300. Although not the case in this example embodiment, in some embodiments the flange-receiving opening S extends entirely through the second core 200 (but not the separator 300). Other embodiments of the protective packaging device 10 have additional openings so the protective packaging device 10 can be installed onto any of multiple different windows of different sizes. In certain embodiments, the two ends of the outer wrap 600 are spaced-apart at the junction 610*a* and form the part of the flange-receiving opening S defined through the outer wrap 600.

In this example embodiment, the height $H_s$ of the flange-receiving opening S is at least equal to the distance $D_{1600}$ (explained above with reference to FIG. 10) to ensure the flange 1600 of the window 1000 can be entirely received in the flange-receiving opening S. In this example embodiment, the thickness $t_s$ of the flange-receiving opening S is slightly smaller than the thickness of the flange 1600 of the window 1000 (not labeled). In other embodiments, the thickness $t_s$ of the flange-receiving opening S is equal to or larger than the thickness of the flange 1600. In this example embodiment, the distance D between the flange-receiving opening S and the first side wall 620 of the outer wrap 600 is at least equal to the distance $D_{1100}$ (explained above with reference to FIG. 10) to ensure the entire rail and/or stile of the window 1000 (depending on how the protective packaging device 10 is installed on the window 1000) contacts the top wall 610 of the outer wrap 600 after the protective packaging device 10 is installed on the window 1000. In other embodiments, the distance D may be any suitable distance, and the entire rail or stile does not contact the top wall 610 of the outer wrap 600 after the protective packaging device 10 is installed on the window 1000.

In this example embodiment, the second core 200 and the outer wrap 600 are cut via a blade or other suitable cutting device to form the flange-receiving opening S. In other embodiments, the second core 200 is formed from two core components that are attached to the separator 300 in a spaced-apart manner so the flange-receiving opening S is defined between the two core components. These are merely examples, and the flange-receiving opening S may be formed in any suitable manner.

As best shown in FIGS. 2 and 3, the retaining material 700—here an adhesive—is present in the flange-receiving opening S. Although shown here at the bottom of the flange-receiving opening S, the retaining material 700 may also or alternatively be present along the sides of the flange-receiving opening S. The retaining material 700 may be present continuously or intermittently along the length of the flange-receiving opening S. The retaining material 700 may be any suitable material—such as a pressure-sensitive hot or cold adhesive that remains tacky at room temperature, tape, or sandpaper—configured to engage to the flange 1600 when the flange is inserted into the flange-receiving opening S and help retain the flange in the flange-receiving opening 700. For instance, in the case of an adhesive, the adhesive removably adheres the flange to the second core. In this way, the retaining material 700 helps retain the protective packaging device 10 in place on the window 1000 while still facilitating easy removal when desired.

Figure 11:
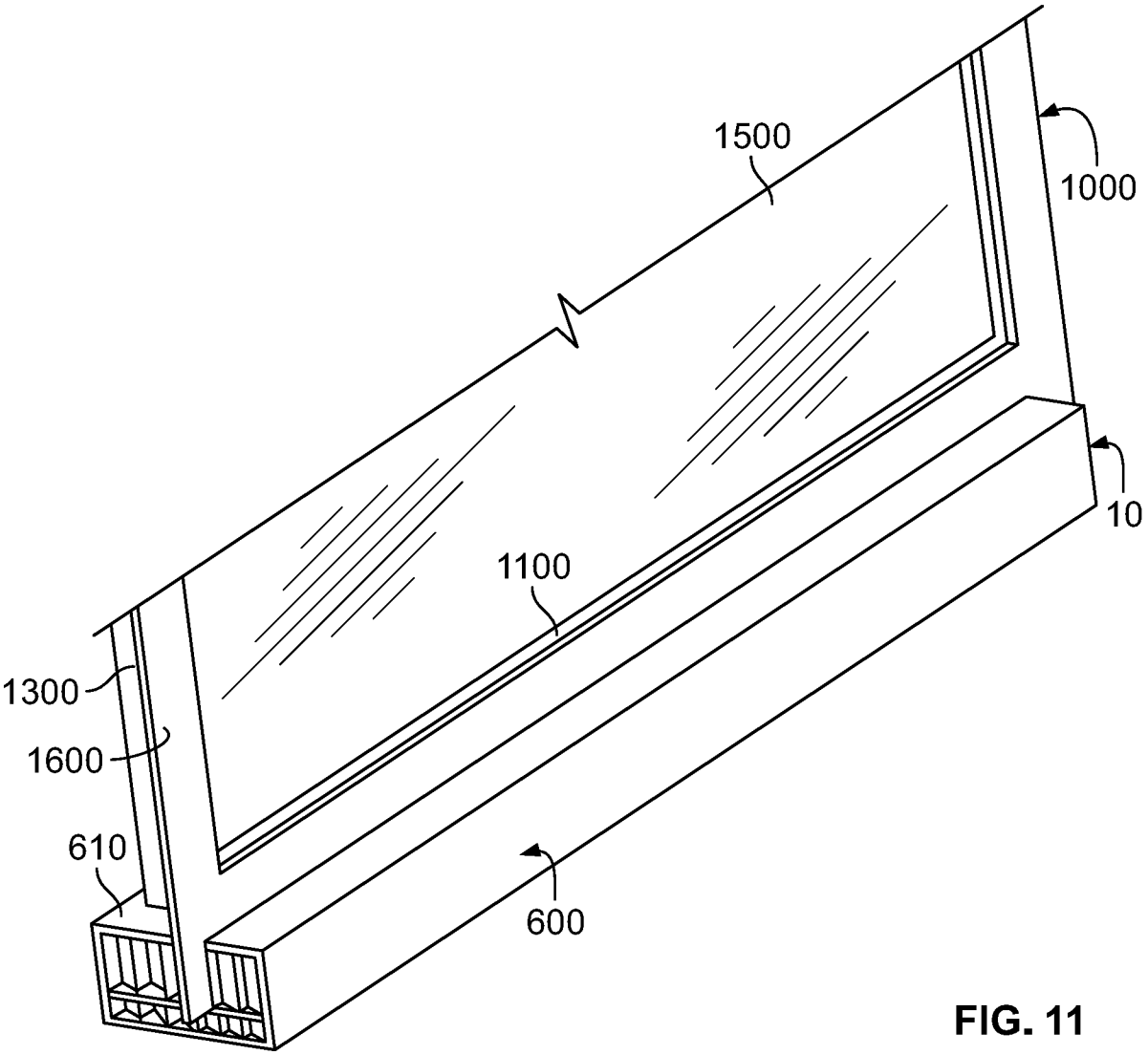
FIG. 11 is a fragmentary perspective view of the protective packaging device of FIG. 1 installed on the window of FIG. 10.

To install the protective packaging device 10 onto the window 1000, a user aligns the outer edge of the flange 1600 of the window 1000 with the entrance to the flange-receiving opening S of the protective packaging device 10. The user then pushes the protective packaging device 10 toward the window 1000 such that the flange 1600 enters the flange-receiving opening S. The user continues pushing until the closest rail and/or stile of the window 1000 contacts the top wall 610 of the outer wrap 600. As the flange 1600 moves into the flange-receiving opening S, the retaining material 700—here an adhesive—removably adheres the flange 1600 to the second core 200. FIG. 11 shows the protective packaging device 10 installed onto the window 1000. After installation, the retaining material 700 retains the protective packaging device 10 on the window 1000 during storage, shipping, and handling, yet enables a user to easily remove the protective packaging device 10 when desired. In embodiments in which the thickness $t_s$ of the flange-receiving opening S is smaller than or equal to the thickness of the flange 1600, friction between the flange 1600 and the top wall 610 of the outer wrap 600, the second core 200, and the second core cover 400 also helps retain the protective packaging device 10 on the window 1000.

The use of the vertically stacked first and second cores 100 and 200—only the second of which includes the flange-receiving opening S—separated by the separator 300 provides several benefits. First, the first core 100 (which does not include the flange-receiving opening S) provides increased lateral stability, rigidity, and strength (compared to a single core with the flange-receiving opening S) to the protective packaging device 10. Second, the separator 300 acts as a barrier that prevents the flange-receiving opening S from propagating into (and possibly through) the first core 100, thereby preventing the loss of stability, rigidity, and strength that could be caused by this type of propagation. Third, the separator 300 acts as a barrier positioned so the retaining material 700, once inserted into the flange-receiving opening, is located where the flange 1600 of the window 1000 can contact the retaining material 700. The separator 300 prevents the retaining material 700 from moving (e.g., flowing in the case of an adhesive) into the first core 100 where the flange 1600 does not reach and, therefore, where the retaining material 700 is not needed.

Although only one protective packaging device 10 is shown installed onto the window 1000, additional protective packaging devices 10 may be installed onto the other three sides of the flange 1600 to protect those areas of the flange 1600.

Although the protective packaging device 10 is described above in conjunction with the window 1000, the protective packaging device 10 may be sized, shaped, and otherwise configured to be installed onto (and to protect) any suitable type of product.

In other embodiments (not shown), the flange-receiving opening extends downward from the top wall of the outer wrap, proceeds through the second core, proceeds through the separator, and proceeds partially through the first core before terminating. In these embodiments, the retaining material may be present within the flange-receiving opening between the separated portions of the separator and may removably adhere those portions of the separator together. In these embodiments, the fact that the flange-receiving opening extends through the separator enables the component of the product (such as a flange of a window) to extend through the separator if it is longer than the height of the second core. This prevents the separator from damaging the component of the product while ensuring the product can completely seat against the top wall of the outer wrap.

The invention claimed is:

1. A protective packaging device comprising:

a first core having a top side and a bottom side;

a separator having a top side and a bottom side, wherein the bottom side of the separator is attached to the top side of the first core;

a second core having a top side, a bottom side, and a length, wherein the top side of the separator is attached to the bottom side of the second core so the separator is between the first and second cores, wherein an opening is defined at least partially through the second core along at least part of the length of the second core and extends from the top side of the second core toward the separator;

a retaining material disposed within the opening and configured to engage a component of a product introduced into the opening to retain the component of the product in the opening; and an outer wrap wrapped around and partially enclosing the first core, the second core, and the separator, wherein the opening extends through the outer wrap.

2. The protective packaging device of claim 1, wherein the retaining material comprises a retaining adhesive configured to removably attach the second core to the component of the product introduced into the opening.

3. The protective packaging device of claim 1, further comprising a first core cover between the bottom side of the first core and the outer wrap and a second core cover between the top side of the second core and the outer wrap.

4. The protective packaging device of claim 3, wherein the first core cover is attached to the bottom side of the first core, wherein the second core cover is attached to the top side of the second core, and wherein at least one of the first and second core covers is attached to the outer wrap.

5. The protective packaging device of claim 4, wherein the outer wrap is formed from a single unitary piece of chipboard.

6. The protective packaging device of claim 2, wherein the first and second cores each comprise a cellular structure formed from paperboard.

7. The protective packaging device of claim 6, wherein the first core comprises cells with larger cross-sectional areas than cells of the second core.

8. The protective packaging device of claim 6, wherein the separator comprises paperboard.

9. The protective packaging device of claim 8, further comprising an outer wrap wrapped around and partially enclosing the first core, the second core, and the separator, wherein the opening extends through the outer wrap.

10. The protective packaging device of claim 9, further comprising a first core cover between the bottom side of the first core and the outer wrap and a second core cover between the top side of the second core and the outer wrap.

11. The protective packaging device of claim 10, wherein the first core cover is attached to the bottom side of the first core, wherein the second core cover is attached to the top side of the second core, and wherein at least one of the first and second core covers is attached to the outer wrap.

12. The protective packaging device of claim 11, wherein the outer wrap is formed from a single unitary piece of chipboard.

13. The protective packaging device of claim 2, wherein the separator prevents the retaining adhesive from moving into the first core.

14. The protective packaging device of claim 2, wherein the opening is defined at least partially through the second core along the entire length of the second core.

15. The protective packaging device of claim 2, wherein the opening is defined entirely through the second core.

16. The protective packaging device of claim 15, wherein the opening is defined through the separator.

17. The protective packaging device of claim 16, wherein the opening is defined partially through the first core.

18. The protective packaging device of claim 2, wherein the opening terminates before reaching the separator.

19. A protective packaging device comprising:

a first core having a top side, a bottom side, and a first height, wherein the first core comprises hexagonal cells that form a first honeycomb structure;

a separator having a top side and a bottom side, wherein the bottom side of the separator is attached to the top side of the first core;

a second core having a top side, a bottom side, a length, and a second height that is greater than the first height, wherein the second core comprises hexagonal cells that form a second honeycomb structure that is vertically aligned with the first honeycomb structure, wherein the top side of the separator is attached to the bottom side of the second core so the separator is between the first and second cores, wherein an opening is defined at least partially through the second core along at least part of the length of the second core and extends from the top side of the second core toward the separator; and a retaining material disposed within the opening and configured to engage a component of a product introduced into the opening to retain the component of the product in the opening.

20. The protective packaging device of claim 19, wherein the first honeycomb has a first cell cross-sectional area and the second honeycomb has a second cell cross-sectional area, and wherein the first cross-sectional area is larger than the second cross-sectional area.

21. A protective packaging device comprising:

a first core having a top side and a bottom side;

a separator having a top side and a bottom side, wherein the bottom side of the separator is attached to the top side of the first core;

a second core having a top side, a bottom side, and a length, wherein the top side of the separator is attached to the bottom side of the second core so the separator is between the first and second cores, wherein an opening is defined at least partially through the second core along at least part of the length of the second core and extends from the top side of the second core toward the separator, wherein the opening terminates within the second core before reaching the separator; and a retaining material disposed within the opening and configured to engage a component of a product introduced into the opening to retain the component of the product in the opening.

22. The protective packaging device of claim 21, wherein:

the retaining material comprises a retaining adhesive configured to removably attach the second core to the component of the product introduced into the opening;

the first and second cores each comprise a cellular structure formed from paperboard;

the first core comprises cells with larger cross-sectional areas than cells of the second core;

the separator comprises paperboard; and the separator prevents the retaining adhesive from moving into the first core.

* * * * *